US005945970A

United States Patent [19]

Moon et al.

[11] Patent Number: 5,945,970

[45] **Date of Patent: *Aug. 31, 1999**

[54] LIQUID CRYSTAL DISPLAY DEVICES HAVING IMPROVED SCREEN CLEARING CAPABILITY AND METHODS OF OPERATING SAME

[75] Inventors: Seung-Hwan Moon; Sun-Yung Kwon, both of Seoul; Ju-Man Lee, Kyungki-do; Hyong-Gon Lee, Seoul, all of Rep. of Korea

[73] Assignee: Samsung Electronics Co., Ltd., Suwon, Rep. of Korea

[ * ] Notice: This patent is subject to a terminal disclaimer.

[21] Appl. No.: 08/978,611

[22] Filed: Nov. 26, 1997

Related U.S. Application Data

[63] Continuation-in-part of application No. 08/708,186, Sep. 6, 1996, Pat. No. 5,793,346.

[30] Foreign Application Priority Data

Nov. 27, 1996 [KR] Rep. of Korea ..... 96-58389

[51] Int. Cl.[6] ..... G09G 3/36; G09G 5/00

[52] U.S. Cl. ..... 345/92; 345/211; 345/214

[58] Field of Search ..... 345/214, 98, 94, 345/92, 96, 211; 395/750; 359/59

[56] References Cited

U.S. PATENT DOCUMENTS

| | | | |
|---|---|---|---|
| 4,422,163 | 12/1983 | Oldenkamp | 365/229 |
| 5,248,963 | 9/1993 | Yasui et al. | 345/98 |
| 5,430,460 | 7/1995 | Takabatake et al. | 345/96 |
| 5,448,384 | 9/1995 | Uchino et al. | 359/59 |
| 5,526,012 | 6/1996 | Shibahara | 345/92 |
| 5,572,735 | 11/1996 | Tanikawa | 395/750 |
| 5,602,560 | 2/1997 | Ikeda | 345/94 |

FOREIGN PATENT DOCUMENTS

| | | |
|---|---|---|
| 0 364 590 A1 | 4/1990 | European Pat. Off. . |
| 0 605 846 A1 | 7/1994 | European Pat. Off. . |

OTHER PUBLICATIONS

European Search Report, Mar. 18, 1997.

*Primary Examiner*—Jeffery Brier
*Assistant Examiner*—David L Lewis
*Attorney, Agent, or Firm*—Myers Bigel Sibley & Sajovec

[57] ABSTRACT

Liquid crystal display devices include an array of liquid crystal display cells arranged as a plurality of columns of display cells electrically coupled to respective data lines and a plurality of rows of display cells electrically coupled to respective gate lines. A gate line on/off voltage generator and gate line driving circuit are provided to drive at least a first gate line with a turn-on voltage of first polarity (e.g., positive voltage) and simultaneously driving at least a second gate line with a turn-off voltage of second polarity (e.g., negative voltage). First and second screen clearing circuits are also provided to improve the screen clearing capability of the liquid crystal display device. The first screen clearing circuit can be electrically coupled to the first gate line to perform the function of driving the first gate line from the turn-on voltage (e.g., positive voltage) to a ground reference voltage upon termination of a power supply signal; and the second screen clearing circuit of different design can be electrically coupled to the second gate line to perform the function of driving the second gate line from the turn-off voltage (e.g., negative voltage) to the ground reference voltage upon termination of the power supply signal. These driving functions may act to increase the conductivity of the TFTs in the "off" display cells and thereby improve the rate of charge leakage from the storage capacitors and the liquid crystal capacitors therein.

17 Claims, 9 Drawing Sheets

LIQUID CRYSTAL DISPLAY DEVICES HAVING IMPROVED SCREEN CLEARING CAPABILITY AND METHODS OF OPERATING SAME

CROSS-REFERENCE TO RELATED APPLICATION

This application is a continuation-in-part of U.S. application Ser. No. 08/708,186, entitled "Liquid Crystal Display Devices Having Active Screen Clearing Circuits Therein", filed Sep. 6, 1996, now U.S. Pat. No. 5,793,346 the disclosure of which is hereby incorporated herein by reference.

FIELD OF THE INVENTION

The present invention relates to liquid crystal display devices and methods of operating same.

BACKGROUND OF THE INVENTION

In a conventional TFT LCD (thin-film transistor liquid crystal display), a pixel is comprised of a thin film transistor, a liquid crystal capacitor (Cp) and a storage capacitor (Cst). The transistor serves as a switch for the voltage applied to the liquid crystal capacitor. In the turn-on duration of the transistor, the liquid crystal capacitor is charged by a gray voltage corresponding to a color signal in the pixel. The storage capacitor may be connected to the liquid crystal capacitor in parallel, thereby preventing the charged voltage across the liquid crystal capacitor from leaking out during the turn-off duration of the transistor. In such a TFT LCD, the voltage for turning on the TFT is called "gate-on" voltage, and the voltage for turning off the TFT is called "gate-off" voltage. In actual applications, the gate-on voltage is more than 20V, and the gate-off voltage is less than −7V. As the liquid crystal panel becomes larger and has higher resolution, a gate on/off voltage having a larger DC level is typically required. In the TFT LCD, the voltage charged in the liquid crystal capacitor controls the transmittance of the light passing through the liquid crystal in the corresponding pixel, and thus a color display is formed.

FIG. 1 shows a typical current-voltage characteristic of a TFT. Referring to FIG. 1, when the voltage Vgs between gate and source of a TFT is Von, a current flows through the TFT to cause the voltage at source electrode (e.g., data line) to be applied to the liquid crystal capacitor. When the voltage Vgs is Voff, current through the TFT is greatly restricted to a level loff, thereby preventing leakage of the charge stored in the liquid crystal capacitor. On the other hand, when the voltage Vgs is 0V, a low level current flows through the TFT to discharge the liquid crystal capacitor.

A conventional TFT LCD will now be described in connection with the attached drawings. As shown in FIG. 2, a TFT LCD includes a timing control circuit 1, a gate driving circuit 2, a source driving circuit 3, a gray voltage generator 4, a liquid crystal panel 5 and a gate on/off voltage generator 6. The timing control circuit 1 receives color signals RGB, horizontal and vertical synchronization signals Hsync and Vsync and a clock signal CLK. The output of the timing control circuit 1 is supplied to the gate driving circuit 2 and the source driving circuit 3. The gray voltages produced from the gray voltage generator 4 are supplied to the source driving circuit 3. The gate on/off voltages Von and Voff produced by the gate on/off generator 6 are supplied to the gate driving circuit 2. The liquid crystal panel 5 is comprised of a plurality of gate lines G0–Gn, a plurality of data lines D0–Dn which cross the gate lines and a plurality of pixels.

The gate lines G0–Gn are connected to the gate driving circuit 2, and the data lines D0–Dn are connected to the source driving circuit 3. Each pixel is defined by the gate and the data lines, and has a TFT, a storage capacitor Cst and a liquid crystal capacitor Cp. The gate of the TFT is connected to a gate line, and the source of the TFT is connected to a data line. The liquid crystal capacitor (Cp) and the storage capacitor (Cst) are connected to the drain of the TFT. The liquid crystal capacitor and storage capacitor may be connected in parallel. However, a common electrode voltage (Vcom) may be applied to the opposite terminal of the liquid crystal capacitor and the opposite terminal of the storage capacitor may be connected to a previous gate line, as illustrated. Accordingly, the voltage across the liquid crystal capacitor is determined by the voltage difference between the common electrode voltage (Vcom) and the data line voltage and the voltage across the storage capacitor is determined by the voltage difference between the data line voltage and the previous gate line voltage. In such a panel structure, no pixel is connected to the first gate line G0. As will be understood by those skilled in the art, such a panel structure has a high opening ratio since it does not require additional lines to obtain the storage capacitance. For this reason, the illustrated TFT LCD panel structure is widely used.

In FIG. 2, the timing control circuit 1 controls the timing of the color signals RGB and generates control signals to operate the driving circuits 2 and 3. The gray voltage generator 4 produces a plurality of gray voltages, and the gate on/off voltage generator 6 produces gate-on and gate-off voltages. The gray voltages are supplied to the source driving circuit 3, and the gate-on and the gate-off voltages are supplied to the gate driving circuit 2. By using the gate on/off voltage and the output of the timing control circuit 1, the gate driving circuit 2 generates gate driving voltages that enable each row of pixels to be turned on sequentially for one horizontal scanning time. These gate driving voltages are applied to corresponding gate lines. The one horizontal scanning time interval is defined as the time to be taken in applying data driving voltages to all the pixels connected to one gate line. The source driving circuit 3 selects one of all the gray voltages in accordance with the color signals RGB which are inputted sequentially from the timing control circuit 1, and applies the selected gray voltage onto the corresponding data line. Then, each data line voltage is transferred to a corresponding pixel.

FIG. 3 is a typical timing diagram of the gate driving voltage implemented in a TFT LCD having the structure of FIG. 2. As shown in FIG. 3, a gate line Gn−1 is in an on-state for one horizontal scanning time in a frame duration, and is in an off-state for the rest of the time in the frame duration. Each gate line is turned on sequentially. The operation of the liquid crystal panel in a gate on/off state will now be further described. For example, when a gate-on voltage is applied to the gate line G1 in FIG. 2, and gate-off voltages are applied to the other gate lines, all the TFTs connected to the gate line G1 are turned on by the gate-on voltage. Then, the data driving voltage in each data line D1–Dm is applied to the liquid crystal capacitor Cp1 and the storage capacitor Cst1 through the corresponding TFT which is turned on. Thus, the liquid crystal capacitor Cp1 are charged by a difference between the data driving voltage and the common electrode voltage (Vcom), and the storage capacitors Cst1 are charged by a difference between the data driving voltage and the gate-off voltage of the previous gate line G0. Because the voltage across the storage capacitor is typically larger than the voltage across the liquid crystal capacitor, charges from the storage capacitor are typically supplied to the liquid crystal capacitor. Accordingly, the liquid crystal capacitor can be held in a charged state even after the corresponding gate line voltage is removed.

However, when a user turns off a power switch or an interruption in the power supply occurs, the performance of the conventional circuit described above may be limited. For example, immediately before the power supply is removed from a TFT LCD, the voltage Voff is applied to the gate electrodes of most of the TFTs. Accordingly, even during the power off state, the charge stored in a liquid crystal capacitor may not be immediately discharged because the corresponding TFT connected thereto remains off. Furthermore, the liquid crystal in the panel can be degraded by the dc voltages which remain after the power supply is removed.

SUMMARY OF THE INVENTION

It is therefore an object of the present invention to provide improved liquid crystal display devices, and methods of operating same.

It is another object of the present invention to provide liquid crystal display devices having improved screen clearing capability upon termination of power, and methods of operating same.

These and other objects, advantages and features of the present invention are provided by liquid crystal display devices which contain an array of liquid crystal display cells arranged as a plurality of columns of display cells electrically coupled to respective data lines and a plurality of rows of display cells electrically coupled to respective gate lines. A gate line on/off voltage generator and gate line driving circuit are also preferably provided to drive at least a first gate line with a turn-on voltage of first polarity (e.g., positive voltage) and simultaneously driving at least a second gate line with a turn-off voltage of second polarity (e.g., negative voltage). First and second screen clearing circuits of preferred design are also provided to improve the screen clearing capability of the liquid crystal display device.

In particular, a first screen clearing circuit can be electrically coupled to the first gate line to perform the function of driving the first gate line from the turn-on voltage (e.g., positive voltage) to a ground reference voltage upon termination of a power supply signal. In addition, a second screen clearing circuit of different design can be electrically coupled to the second gate line to perform the function of driving the second gate line from the turn-off voltage (e.g., negative voltage) to the ground reference voltage upon termination of the power supply signal. These driving functions may act to increase the conductivity of the TFTs in the "off" display cells and thereby improve the rate of charge leakage from the storage capacitors and the liquid crystal capacitors therein. Moreover, these driving circuits actively drive all gate lines to ground so that the gate lines (and electrodes of storage capacitors electrically connected thereto) can be readily discharged upon termination of the power supply signal. These separate driving functions are preferably performed by separate charge pumps which release energy upon termination of the power supply signal.

According to a first preferred embodiment of the present invention, the first screen clearing circuit comprises an NMOS transistor electrically coupled in series between the first gate line and a ground reference signal line and the second screen clearing circuit comprises a PMOS transistor electrically coupled in series between the second gate line and the ground reference signal line. The first screen clearing circuit also comprises a first charge pump for driving the NMOS transistor with a positive voltage and the second screen clearing circuit comprises a second charge pump for driving the PMOS transistor with a negative voltage. Here, the NMOS transistor is preferably electrically coupled in series between the first gate line and a ground reference signal line and the PMOS transistor is preferably electrically coupled in series between the second gate line and the ground reference signal line. According to another embodiment of the present invention, the first screen clearing circuit may comprise a first charge pump having a CMOS inverter therein for driving an NMOS transistor with a positive voltage.

The present invention also includes preferred methods of clearing display cells upon termination of a power supply signal. In particular, these preferred methods include the steps of driving a first row of display cells with a turn-on voltage of a first polarity while simultaneously driving a second row of display cells with a turn-off voltage of a second polarity, opposite the first polarity. Steps are then performed to clear the display cells in the first and second rows by driving the gate line connected to the first row of display cells to a ground reference potential, using a first charge pump to supply a voltage of the first polarity, while simultaneously driving the gate line connected to the second row of display cells to the ground reference potential using a second charge pump to supply a voltage of the second polarity.

DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 2:
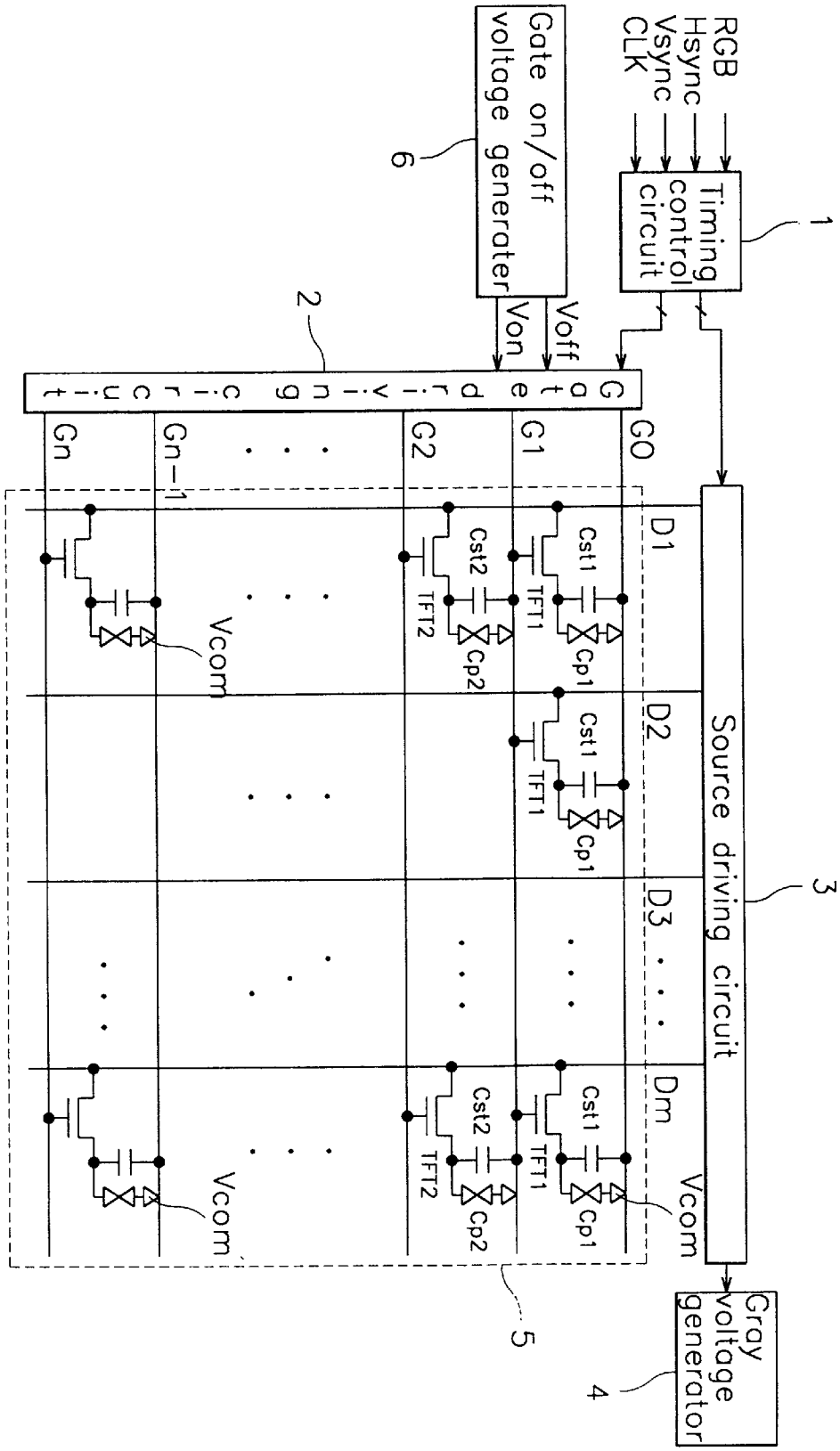
FIG.2(Prior Art)
FIG. 2 is a block electrical schematic of a conventional thin-film transistor (TFT) liquid crystal display device.
Figure 3:
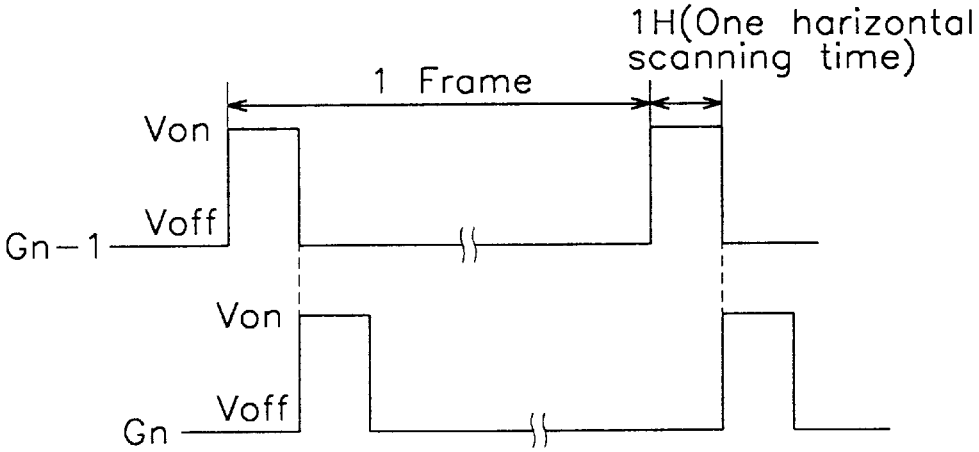
FIG.3(Prior Art)
FIG. 3 is a diagram illustrating the timing of gate line signals in the display device of FIG. 2.
Figure 5:
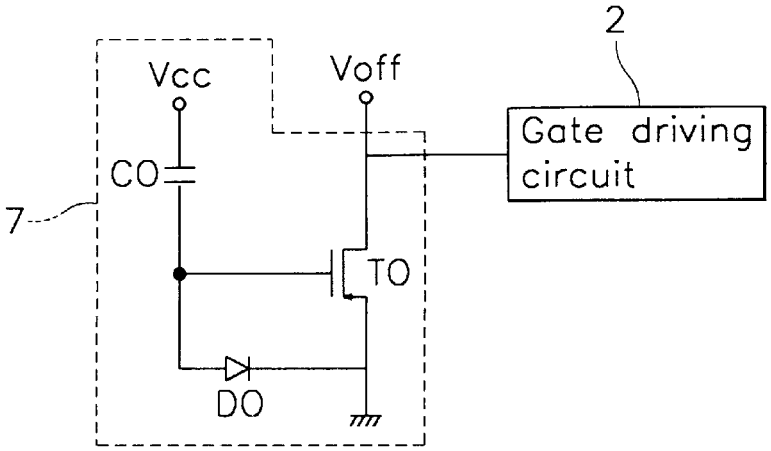
FIG. 5 is an electrical schematic of a second display clearing circuit, according to the present invention.
Figure 4:
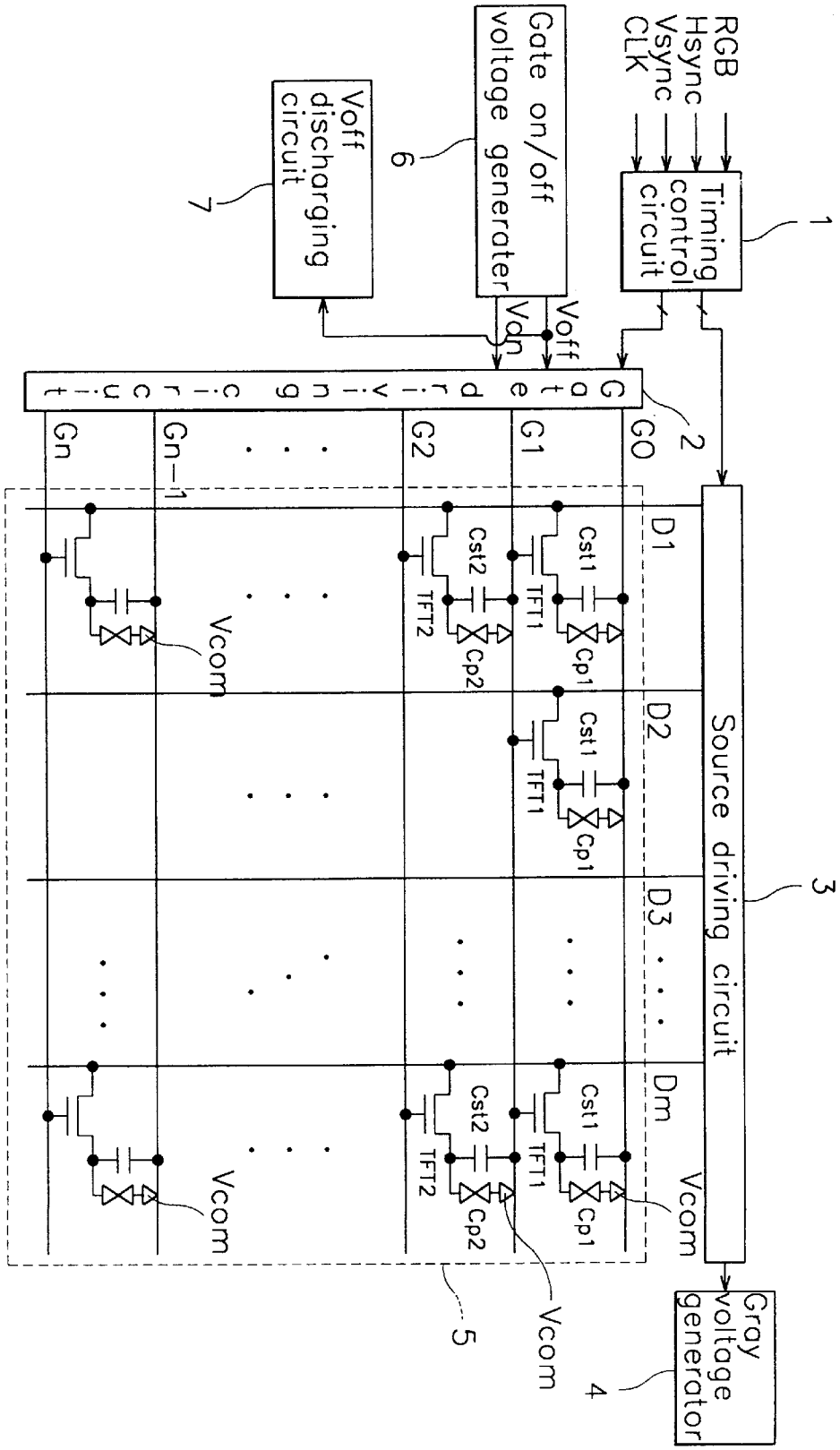
FIG. 4 is a block electrical schematic of a thin-film transistor (TFT) liquid crystal display device, according to a first embodiment of the present invention.

Referring now to FIGS. 4–5, a first embodiment of the invention will be described. As shown in FIG. 4, an LCD having a preferred power-off discharging circuit includes a timing control circuit 1, a gate driving circuit 2, a source driving circuit 3, a gray voltage generator 4, a liquid crystal panel 5, a gate on/off generator 6 and a power off discharging circuit 7. In FIG. 4, the elements which are substantially the same as those in FIG. 2 have been denoted with the same reference numbers. As illustrated, the power-off discharging circuit 7 according to a first embodiment of the invention is connected to the gate off terminal between the gate on/off voltage generator 6 and the gate driving circuit 2. The power off discharging circuit 7 in the first embodiment will be referred to as the Voff discharging circuit or the second screen clearing circuit.

FIG. 5 shows a detailed view of the Voff discharging circuit of FIG. 4. As shown in FIG. 5, the Voff discharging circuit 7 includes a PMOS transistor T0, a capacitor C0 and a diode D0. One of the terminals of the capacitor C0 is connected to supply voltage VCC, and the anode of the diode D0 and the gate of the transistor T0 are connected to the other terminal of the capacitor. The cathode of the diode D0 and the source of the transistor T0 are grounded. The drain of the transistor T0 is connected to a gate off terminal of the gate on/off voltage generator 6 and to the gate lines G0–Gn. Next, referring to FIGS. 4 and 5, the operation of the Voff discharging circuit 7 of the first embodiment will be described. In FIG. 5, the voltage Vn0 at the node between the anode of the diode D0 and the capacitor C0 is Vth0–Vgnd, where Vth0 and Vgnd represent the threshold voltage of the diode and ground voltage, respectively. Accordingly, when the supply voltage VCC is applied to the capacitor C0, the capacitor C0 is charged as follows:

$$Q=C1\times(VDD-Vth0-Vgnd)$$

Assuming that VCC, Vth0, Vgnd are 5V, 0.7V, 0V, respectively, the voltage Vn0 becomes 0.7V and the stored charge Q in the capacitor C0 becomes 4.3×C1. At this time, since the voltage Vn0 is greater than the threshold voltage Vthp of the PMOS transistor (i.e., Vn0>Vthp, where Vthp is typically negative), the PMOS transistor is turned off.

Figure 1:
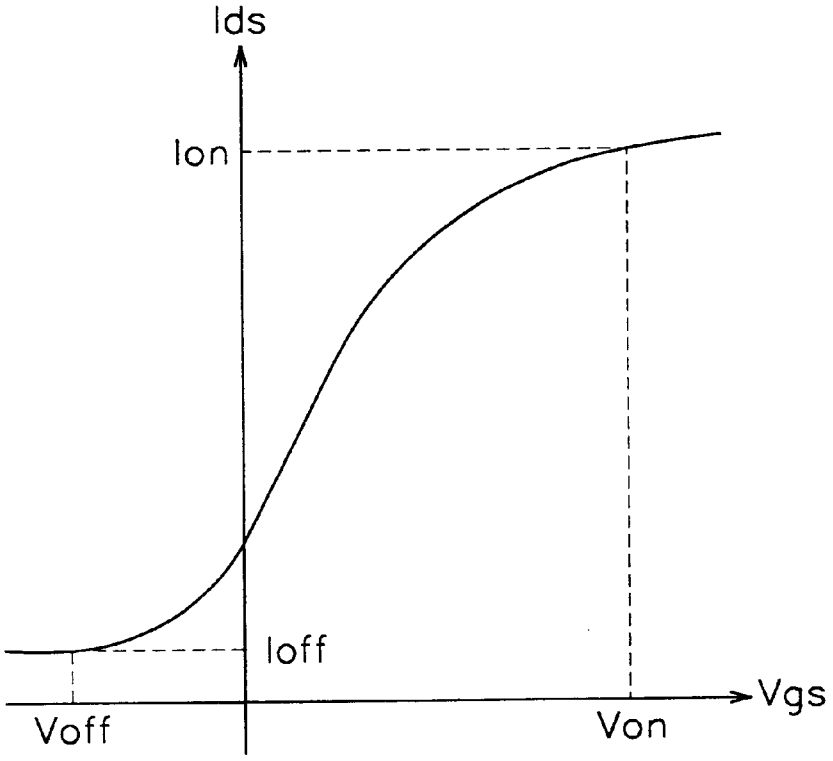
FIG. 1 (Prior Art)
FIG. 1 is an I–V characteristic curve for a thin-film transistor having a negative threshold voltage.

Then, when the supply voltage is shut off, Vcc is set to ground level. However, because the capacitor retains the stored charge Q, the voltage Vn0 is switched from 0V to −4.3V to turn on the PMOS transistor T0. Turn on of the PMOS transistor then drives the voltages of the off gate lines from Voff to ground. As illustrated by FIG. 1, setting the off gate line voltages to ground drives Vgs to 0 Volts so that current through the TFT transistors is increased to a level greater than loff (but less than Ion). Accordingly, the charge stored in the liquid crystal capacitors can be immediately discharged through the TFT to increase the rate at which the display is cleared.

Notwithstanding the ability of the circuit of FIG. 5 to adequately drive the off gate lines from a negative voltage of Voff to 0 Volts, the circuit of FIG. 5 may not significantly influence the amount of charge in the liquid crystal capacitors that are in the row of on TFTs, at the time the power supply is interrupted. To address this limitation of the circuit of FIG. 5, a second embodiment and a third embodiment of this invention relate to a power-on discharging circuit which becomes coupled to the gate line which was receiving the gate on voltage Von when the power supply was interrupted. The discharging circuits of the second and third embodiments are referred to as the Von discharging circuits or first screen clearing circuits hereinafter.

Figure 6:
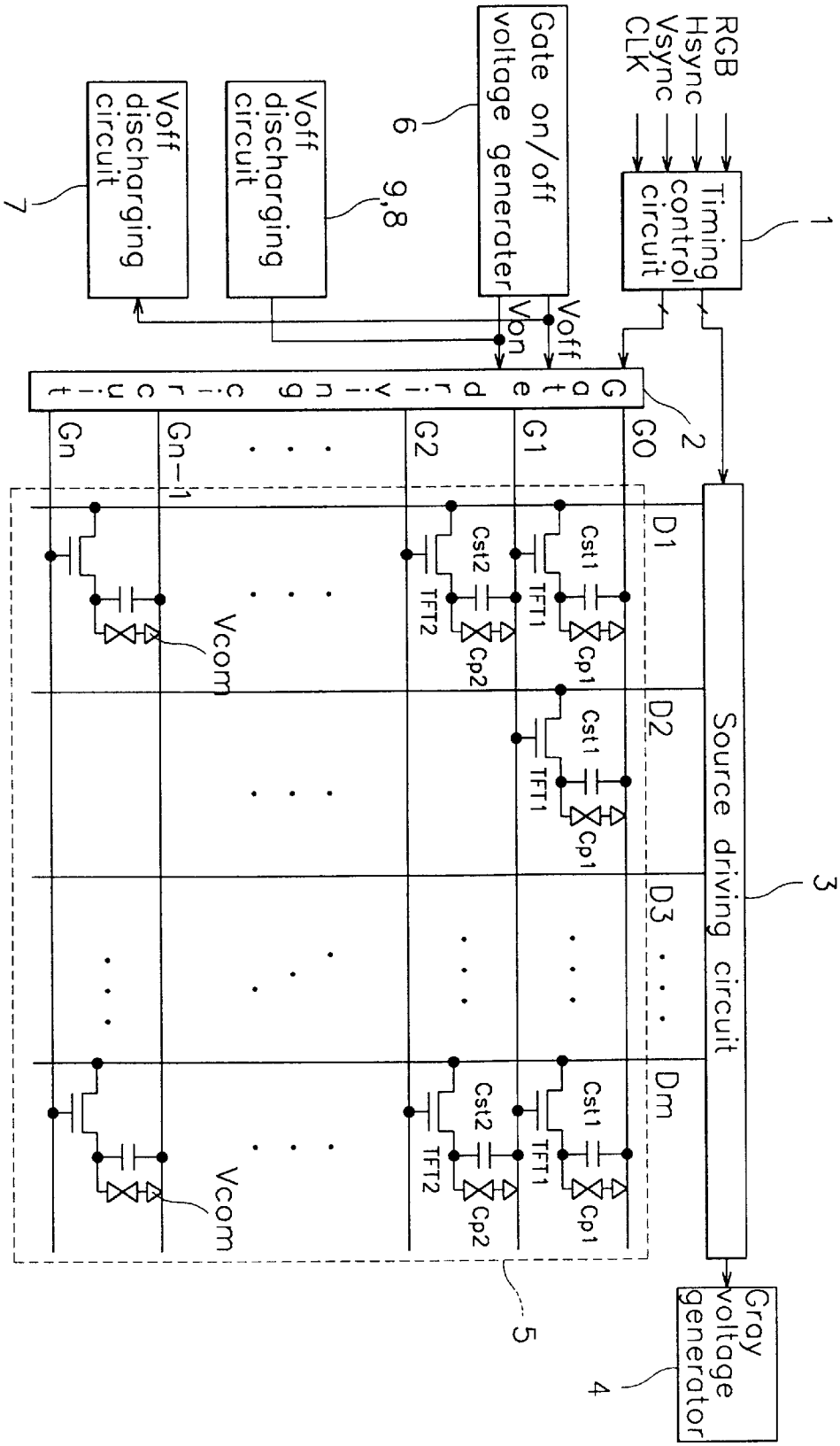
FIG. 6 is a block electrical schematic of a thin-film transistor (TFT) liquid crystal display device, according to a second embodiment of the present invention.

As shown in FIG. 6, a liquid crystal display according to the second embodiment of this invention includes a timing control circuit 1, a gate driving circuit 2, a source driving circuit 3, a gray voltage generator 4, a liquid crystal panel 5, a gate on/off voltage generator 6, a Voff discharging circuit 7 and a Von discharging circuit 8 or 9. In FIG. 6, the elements which are substantially the same as those in FIG. 4 have been indicated by the same reference numbers. The liquid crystal panel 5 may have the structure as described with reference to FIG. 4, and the Von discharging circuit 8 may be connected to the Von terminal of the gate on/off voltage generator 6. Here, the Von terminal can be electrically coupled to one of the gate lines G0–Gn during operation of the display panel 5.

Figure 7:
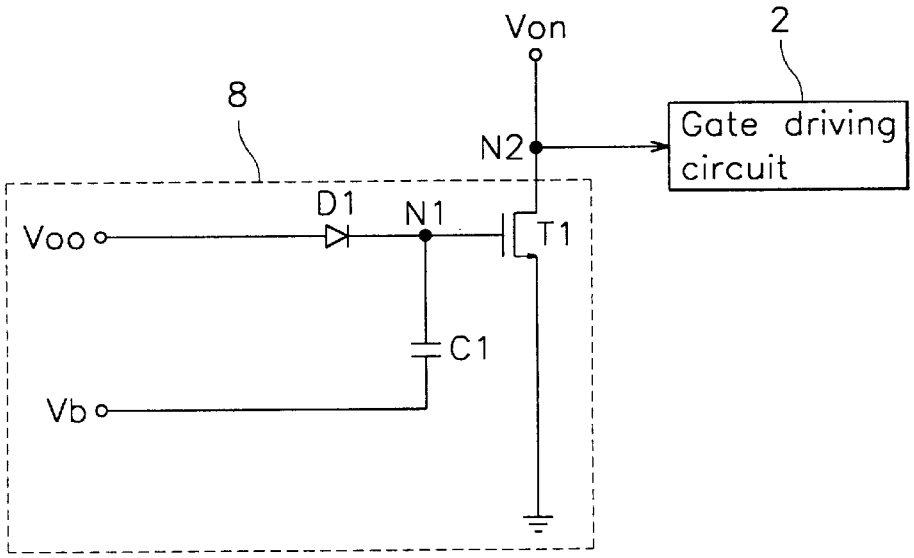
FIG. 7 is an electrical schematic of a first display clearing circuit, according to the present invention.

FIG. 7 is a detailed drawing of the Von discharging circuit 8 in FIG. 6. As shown in FIG. 7, the Von discharging circuit 8 is comprised of a transistor T1, a diode D1 and a capacitor C1. The transistor T1 is an NMOS (n-type metal oxide semiconductor), the drain of the transistor T1 is connected to the gate-on terminal and the source is grounded. The gate of the transistor T1 is connected to the cathode of the diode D1, and the anode of the diode D1 is supplied with a first voltage Va. A second voltage Vb is applied to one terminal of the capacitor C1, and the other terminal of the capacitor C1 is connected to the node N1 between the cathode of the diode D1 and the gate of the transistor T1. It is assumed that the threshold voltage of the diode D1 is Vth1 and the threshold voltage of the transistor T1 is Vth2.

Figure 8:
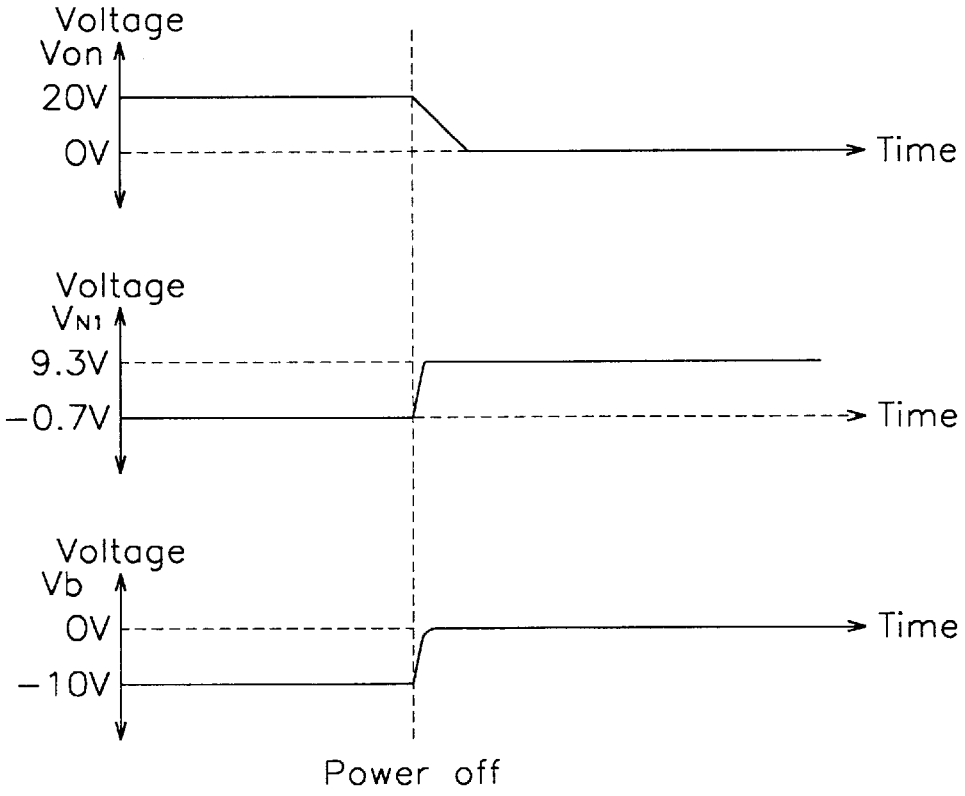
FIG. 8 is a diagram illustrating the timing of signals associated with the display clearing circuit of FIG. 7.

Next, referring to FIGS. 7 and 8, the operation of the above described Von discharging circuit of the second embodiment will be described. In a power-on state, the transistor T1 is turned off so that the voltage of the gate-on terminal does not discharge to ground. However, at the moment the power supply is terminated, the transistor T1 is turned on and thus the voltage of the gate-on terminal discharges rapidly to ground. In this embodiment, the diode D1 and the capacitor C1 with voltages Va and Vb (which actually serve as a power-off detecting circuit by providing a charge pump) determine the bias condition of the transistor T1. Specifically, the bias condition of the transistor T1 is set by the magnitudes of the first and the second voltages which are supplied externally.

In a power-on state, the voltage of the node N1 should be less than the threshold voltage of the transistor T1 (i.e., Vth2) in order to maintain the transistor T1 in an off state. Since the voltage of node N1 is represented as (Va−Vth1), the value Va−Vth1 should be less than Vth2 when the display is active. Accordingly, the first voltage Va should be taken so as to satisfy the condition:

$$Va<Vth1+Vth2$$

In a power-off state, the second voltage Vb is changed to a ground level due to the interruption of the power supply. At the moment of power-off, the voltage corresponding to the magnitude of the voltage across the capacitor C1 during the power-on state appears at the node N1. This operation is commonly called "charge pumping". Since the transistor T1 should be turned on as soon as the power-off state occurs, the voltage across the capacitor C1 in the power-on state should be larger than the threshold voltage Vth2 of the transistor T1. Accordingly, the following condition is obtained: (Va−Vth1)−Vb>Vth2, which can be rewritten as Vb<Va−(Vth1+Vth2).

As an example, if Vth1 and Vth2 are chosen to be 0.7V, a typical threshold voltage, 0V and −10V are chosen for Va and Vb, respectively. The circuitry can be made simpler if the gate-off voltage is used as the second voltage in the second embodiment.

In a power-on state, the diode D1 is turned on and the capacitor C1 maintains the voltage difference between the node voltage $V_{n1}$ and the second voltage Vb. As shown in FIG. 8, the node voltage $V_{n1}$ is −0.7V. The node voltage of −0.7V turns off the transistor T1, and thus the Von voltage can be supplied to the gate driving circuit 2 without discharging through transistor T1.

Then, when power is turned off, the second voltage Vb becomes set to a ground level. Then, the node voltage $V_{n1}$ is shifted up as much as 10V by the above mentioned charge pumping since the second voltage Vb is changed from −10V to 0V. Referring to FIG. 8, it is known that the second voltage Vb becomes set to a ground level and the node voltage $V_{n1}$ becomes 9.3V right after the power-off state. The 9.3V is slowly reduced by the natural discharging of the capacitor C1. Therefore, the transistor T1 is turned on by the 9.3V gate voltage, and thus the voltage of the gate-on terminal in FIG. 6 is quickly reduced through a discharging path.

Figure 9:
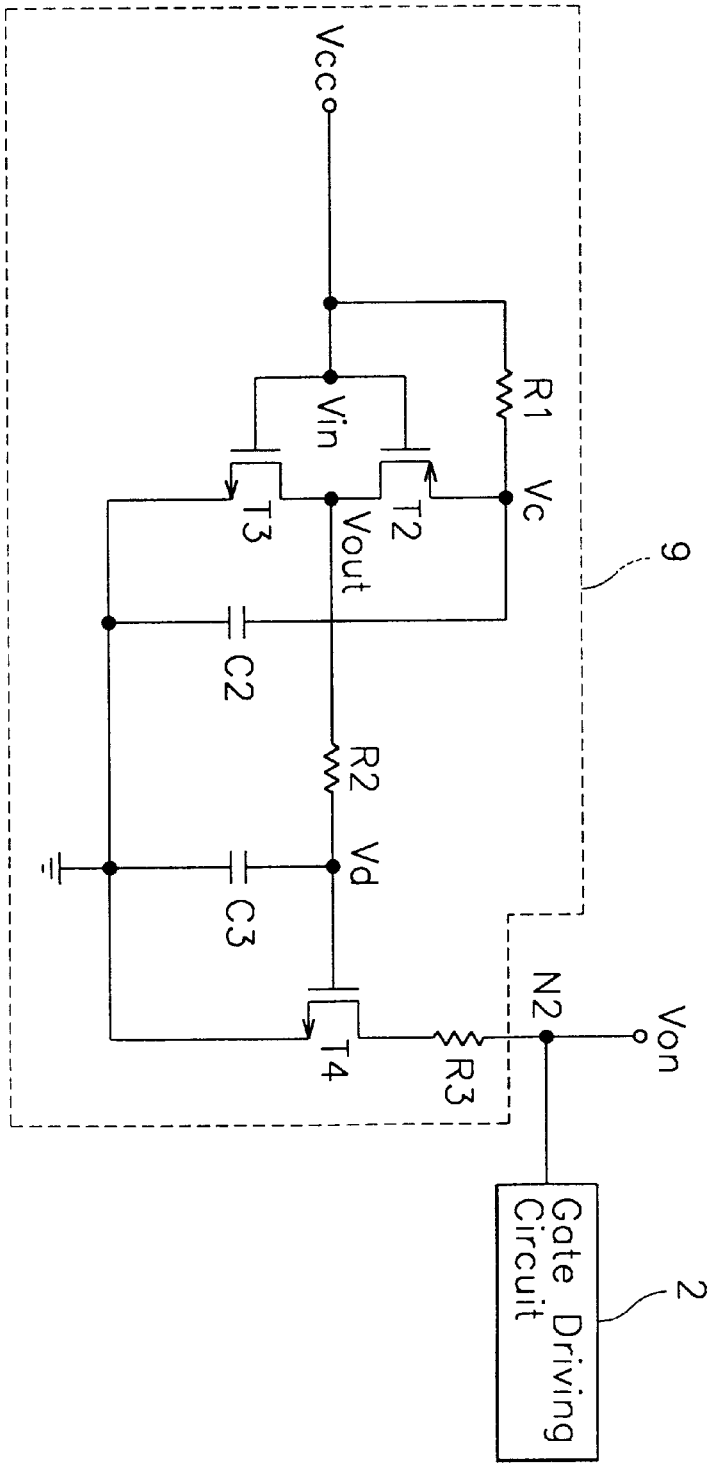
FIG. 9 is an electrical schematic of another first display clearing circuit, according to the present invention.

Next, referring to FIGS. 9 and 10, a third embodiment of the invention will be described. The Von discharging circuit 9 of this embodiment in FIG. 9 (similar to that of the second embodiment) is connected to the gate-on terminal of the gate on/off voltage generator 6. As shown in FIG. 9, the Von discharging circuit 9 of the third embodiment includes a PMOS (p-type metal oxide semiconductor) transistor T2, two NMOS transistors T3 and T4, three resistors R1, R2 and R3, and two capacitors C2 and C3. The value of resistor R3 may be maintained at a low level (e.g., 0 ohms). The two transistors T2 and T3 form a CMOS (complementary metal oxide semiconductor) inverter. Each gate of the two transistors T2 and T3 is connected to each other and forms a common gate, and each drain of the two transistors T2 and T3 is connected to each other and forms a common drain. The common gate serves as an input terminal of the inverter, and the common drain terminal serves as an output terminal of the inverter. To the input terminal of the inverter, a supply voltage VCC (having a typical value of 5V) is applied. The resister R1 is connected between the source of the transistor T2 and the input terminal of the inverter. The source of the transistor T3 is grounded. The capacitor C2 is connected between the source of the transistor T2 and the ground. The drain of the transistor T4 is connected to the node N2 (between the gate-on terminal Von and the gate driving circuit 2) via the resistor R3, and the source of the transistor T4 is grounded. The capacitor C3 is connected between the gate of the transistor T4 and ground. The resistor R2 is connected between the output terminal of the inverter and the gate of the transistor T4. In this embodiment, the threshold voltage of the transistor T2 is set to −1.5V, and each threshold voltage of the transistors T3 and T4 is set to 1.5V. A power-off detecting scheme using the supply voltage VCC, an inverter and an RC circuit is implemented in this embodiment.

In a power-on state, the supply voltage VCC is 5V. The 5V is provided as an input voltage Vin of the inverter, and it turns on the transistor T3. Thus, the output voltage Vout becomes set to a ground level which is the same as 0V. The 0V causes the transistor T4 to be turned off, and thus the voltage of the gate-on terminal Von is provided to the gate driving circuit 2 without being discharged through the pull-down transistor T4.

On the other hand, if the power is turned off, the supply voltage VCC drops down to a ground level. Since the resistor R1 and the capacitor C2 form a series RC circuit, the supply voltage VCC of 0V appears at the node between the resistor R1 and the capacitor C2 after a certain amount of time corresponding to the time constant determined by the resistance and the capacitance of the RC circuit. Thus, the voltage across the capacitor C2 is naturally discharged. As shown by FIG. 10, when the supply voltage VCC is switched to ground level, the node voltage Vc maintains 5V for a time duration t1, which corresponds to the time constant of the RC circuit, and then slowly goes down to a ground level.

During the time interval t1, the transistor T2 is turned on since the gate-source voltage of the transistor T2 is −5V, which is less than the threshold voltage of the transistor T2. Therefore, the common drain voltage Vout of the two transistors T2 and T3 switches to the node voltage Vc. The common drain voltage charges the capacitor C3, and the node voltage Vd between the resistor R2 and the capacitor C3 rises to about 4V. The reason why the node voltage Vd does not rise completely to 5V is because the node voltage Vc drops a little across resistor R2. The waveform of the node voltage Vd is illustrated with respect to time in FIG. 10. The transistor T4 is therefore turned on as soon as the node voltage Vd exceeds 1.5V, which is the threshold voltage of the transistor T4, during the time interval t1. In other words, during the time interval when the node voltage Vd is larger than 1.5V, the transistor T4 is held in a conductive state. The turning-on of the transistor T4 forms a discharging path, and thus the voltage Von of the gate-on terminal can be pulled to ground. But, because resistor R3 is in the series discharging path, the voltage at node N2 may be held temporarily at a sufficient voltage between 0 Volts and Von (see, FIG. 1) so that the drain-to-source current Ids can be kept high to discharge the liquid crystal capacitors quickly. Here, the discharge current may be provided to the data lines. Alternatively, R3 may be set to a low value or omitted altogether in a more preferred embodiment.

Figure 10:
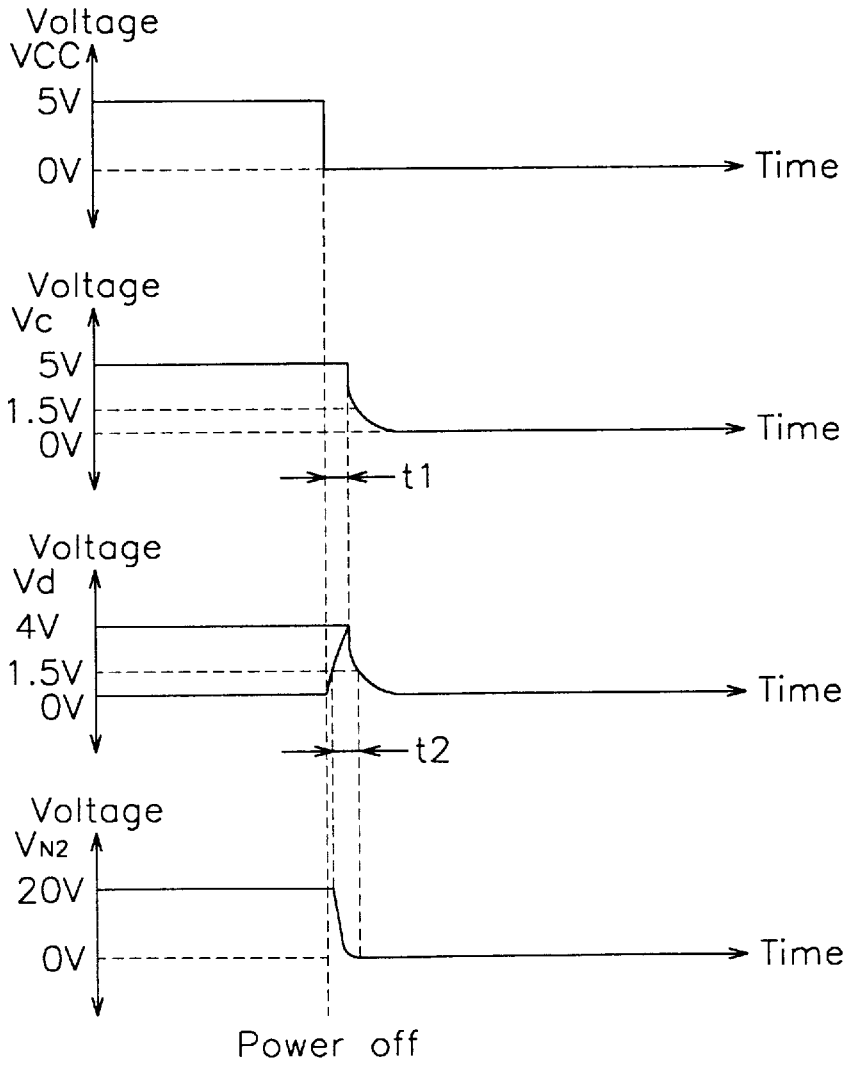
FIG. 10 is a diagram illustrating the timing of signals associated with the display clearing circuit of FIG. 9.

Thus, when the time interval t1 expires, as shown in FIG. 10, the node voltage Vc is reduced gradually by the natural discharging of the capacitor C2. At this time, if the node voltage Vc is larger than 1.5V, the transistor T2 keeps its on-state. As long as the transistor T2 is turned on, the node voltages Vd and Vc vary similarly. Accordingly, when the time interval t1 expires, the node voltage drops off slowly.

When the node voltage Vc drops to a level below 1.5V, the transistor T2 is turned off and the voltage across the capacitor C3 is discharged naturally. The time interval t2 where the node voltage Vc is larger than 1.5V is determined by the time constant of the capacitor C3 and the resistor R2. In particular, the values of R1, R2, C2 and C3 should be selected so that transistor T4 is turned on long enough to fully discharge the liquid crystal-capacitors coupled to the Von gate line.

From another point of view, in the third embodiment, the common drain terminal of the two transistors T2 and T3 can be directly connected to the gate of the transistor T4. In this case, the turn-on time of the transistor T4 can be controlled directly by the time constant of the resistor R1 and the capacitor C2. As known conventionally, the time constant of an RC circuit can be determined by the values of the resistance and the capacitance. Therefore, if the designer selects the resistance and the capacitance appropriately, the required turn-on time can be obtained.

The Von discharging circuit according to the second and the third embodiments detects the power-off state, and enables the voltage in the gate-on terminal to be quickly discharged right after the power-off state. Therefore, the liquid crystal display having the power-off voltage discharging circuit can prevent the phenomenon that the image on the screen disappears slowly because the voltage Von remains on the pixels after the power is turned off. Moreover, the Von discharging circuit of the second and the third embodiments can prevent a degradation of the liquid crystal due to the DC stress by quickly discharging the Von voltage that remains on the panel right after the power-off state.

As described above, the invention has been described in connection with what is presently considered to be the most practical and preferred embodiments, it is understood that the invention is not limited to the disclosed embodiment, but, on the contrary, is intended to cover various modifications and equivalent arrangements included within the spirit and scope of the appended claims.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A liquid crystal display device, comprising:

an array of liquid crystal display cells arranged as a plurality of columns of display cells electrically coupled to respective data lines and a plurality of rows of display cells electrically coupled to respective gate lines;

means, coupled to the gate lines, for driving at least a first gate line with a turn-on voltage of first polarity and simultaneously driving at least a second gate line with a turn-off voltage of second polarity;

a first screen clearing circuit, electrically coupled to the first gate line, to drive the first gate line from the turn-on voltage to a ground reference voltage upon termination of a power supply signal; and a second screen clearing circuit, electrically coupled to the second gate line, to drive at least the second gate line from the turn-off voltage to the ground reference voltage while the first gate line is being driven from the turn-on voltage to the ground reference voltage.

2. The display device of claim 1, wherein the ground reference voltage is intermediate the turn-on voltage and the turn-off voltage.

3. The display device of claim 2, wherein said array of liquid crystal display cells comprises a first row of display cells having thin-film transistors therein electrically coupled to the first gate line and a second row of display cells having thin-film transistors and storage capacitors therein electrically coupled to the second gate line and the first gate line, respectively.

4. The display device of claim 2, wherein said array of liquid crystal display cells comprises an array of thin-film transistor (TFT) liquid crystal display cells having thin-film transistors therein with negative threshold voltages.

5. The display device of claim 2, wherein said first screen clearing circuit comprises an NMOS transistor electrically coupled in series between the first gate line and a ground reference signal line; and wherein said second screen clearing circuit comprises a PMOS transistor electrically coupled in series between the second gate line and the ground reference signal line.

6. The display device of claim 5, wherein said first screen clearing circuit comprises a first charge pump for driving the NMOS transistor with a positive voltage; and wherein said second screen clearing circuit comprises a second charge pump for driving the PMOS transistor with a negative voltage.

7. The display device of claim 4, wherein said first screen clearing circuit comprises an NMOS transistor electrically coupled in series between the first gate line and a ground reference signal line; and wherein said second screen clearing circuit comprises a PMOS transistor electrically coupled in series between the second gate line and the ground reference signal line.

8. The display device of claim 7, wherein said first screen clearing circuit comprises a first charge pump for driving the NMOS transistor with a positive voltage; and wherein said second screen clearing circuit comprises a second charge pump for driving the PMOS transistor with a negative voltage.

9. The display device of claim 5, wherein said first screen clearing circuit comprises a first charge pump for driving the NMOS transistor with a positive voltage; and wherein the first charge pump comprises an inverter having an input responsive to the power supply signal.

10. The display device of claim 9, wherein the inverter comprises a PMOS transistor having a source electrode electrically coupled by a resistor to the input.

11. The display device of claim 10, wherein the first screen clearing circuit comprises a first capacitor electrically coupled between the ground reference signal line and the source electrode of the PMOS transistor.

12. The display device of claim 11, wherein the NMOS transistor is electrically coupled to an output of the inverter.

13. A liquid crystal display device, comprising:

an array of liquid crystal display cells arranged as a plurality of columns of display cells electrically coupled to respective data lines and a plurality of rows of display cells electrically coupled to respective gate lines;

means, coupled to the gate lines, for driving at least a first gate line with a turn-on voltage of first polarity and simultaneously driving at least a second gate line with a turn-off voltage of second polarity, opposite the first polarity; and a first screen clearing circuit electrically coupled to the first gate line, said first screen clearing circuit containing a first polarity charge pump therein to drive the first gate line from the turn-on voltage to a ground reference voltage upon termination of a power supply signal.

14. The display device of claim 13, further comprising a second screen clearing circuit, said second screen clearing circuit containing a second polarity charge pump therein to drive the second gate line from the turn-off voltage to the ground reference voltage upon termination of the power supply signal.

15. The display device of claim 14, wherein the ground reference voltage is intermediate the turn-on voltage and the turn-off voltage.

16. The display device of claim 15, wherein said first screen clearing circuit comprises an NMOS transistor electrically coupled in series between the first gate line and a ground reference signal line; and wherein said second screen clearing circuit comprises a PMOS transistor electrically coupled in series between the second gate line and the ground reference signal line.

17. In a liquid crystal display device containing an array of liquid crystal display cells arranged as a plurality of columns of display cells electrically coupled to respective data lines and a plurality of rows of display cells electrically coupled to respective gate lines, a method of clearing the display cells upon termination of a power supply signal, said method comprising the steps of:

driving a first row of display cells with a turn-on voltage of a first polarity while simultaneously driving a second row of display cells with a turn-off voltage of a second polarity, opposite the first polarity; and clearing the display cells in the first and second rows by driving the gate line connected to the first row of display cells to a ground reference potential using a first charge pump to supply a voltage of the first polarity, while simultaneously driving the gate line connected to the second row of display cells to the ground reference potential using a second charge pump to supply a voltage of the second polarity.

* * * * *